US012491554B2

(12) United States Patent
Martin

(10) Patent No.: US 12,491,554 B2
(45) Date of Patent: Dec. 9, 2025

(54) SYSTEM FOR DISPENSING COILED TUBING

(71) Applicant: Kristian Martin, Prince Rupert (CA)

(72) Inventor: Kristian Martin, Prince Rupert (CA)

( * ) Notice: Subject to any disclaimer, the term of this patent is extended or adjusted under 35 U.S.C. 154(b) by 0 days.

(21) Appl. No.: 19/038,034

(22) Filed: Jan. 27, 2025

(65) Prior Publication Data

US 2025/0170634 A1 May 29, 2025

Related U.S. Application Data

(63) Continuation-in-part of application No. 18/194,492, filed on Mar. 31, 2023, now Pat. No. 12,208,434.

(51) Int. Cl.
*E21B 19/22* (2006.01)
*B21D 26/041* (2011.01)

(52) U.S. Cl.
CPC ..... *B21D 26/041* (2013.01); *E21B 19/22* (2013.01)

(58) Field of Classification Search
CPC ..... E21B 19/22
See application file for complete search history.

(56) References Cited

U.S. PATENT DOCUMENTS

| | | | |
|---|---|---|---|
| 205,069 | A | 6/1878 | Farnsworth |
| 805,579 | A | 11/1905 | Patchen |
| 1,500,921 | A | 7/1924 | Bramson et al. |
| 1,752,193 | A | 3/1930 | O'Hanlon |
| 2,545,701 | A | 3/1951 | McCausland |
| 3,458,219 | A | 7/1969 | Wesch |
| 3,479,067 | A | 11/1969 | Potts |
| 4,091,867 | A | 5/1978 | Shannon, Jr. et al. |
| 4,317,586 | A | 3/1982 | Campbell |
| 4,475,750 | A | 10/1984 | Campbell |
| 4,848,455 | A | 7/1989 | Fenyvesi |
| 4,899,823 | A | 2/1990 | Cobb et al. |
| 5,279,364 | A | 1/1994 | Jantzen et al. |
| 5,454,419 | A | 10/1995 | Moedman |
| 5,803,168 | A | 9/1998 | Lormand et al. |
| 6,006,839 | A | 12/1999 | Dearing et al. |
| 6,209,634 | B1 | 4/2001 | Avakov et al. |
| 6,279,373 | B1 | 8/2001 | Averbuch et al. |
| 6,554,072 | B1 | 4/2003 | Mournian et al. |
| 6,695,048 | B2 | 2/2004 | Andersen et al. |
| 7,165,619 | B2 | 1/2007 | Fox et al. |
| 7,810,556 | B2 | 10/2010 | Havinga |
| 9,228,395 | B2 | 1/2016 | Armstrong et al. |
| 10,787,866 | B2 | 9/2020 | Thomas et al. |
| 2004/0036293 | A1 | 2/2004 | Flindall |
| 2004/0211555 | A1 | 10/2004 | Austbo et al. |
| 2019/0285211 | A1 | 9/2019 | Von Keitz |

FOREIGN PATENT DOCUMENTS

| | | |
|---|---|---|
| GB | 2581959 | 9/2020 |
| WO | 2011096820 | 8/2011 |

*Primary Examiner* — Giovanna Wright
(74) *Attorney, Agent, or Firm* — Craft Chu PLLC; Andrew W. Chu

(57) ABSTRACT

A system for dispensing coiled tubing protects the coiled tubing from the reel to the wellhead. The system includes a reel and a bending apparatus. The bending apparatus includes a conduit with a bend portion and a flexible portion. The bend angle of the conduit is determined by the bend angle of the bend portion and the flexible bend angle of the flexible portion. The flexible portion and the reel determine the reel bend angle. The flexible bend angle is less than the bend angle and the reel bend angle is less than the bend angle so as to prevent excessive bending of the coiled tubing from the reel to the wellhead.

10 Claims, 6 Drawing Sheets

SYSTEM FOR DISPENSING COILED TUBING

CROSS-REFERENCE TO RELATED APPLICATIONS

The present application claims priority under 35 U.S.C. Section 120 from U.S. patent application Ser. No. 18/194,492, filed on 31 Mar. 2023, entitled "BENDING APPARATUS FOR COILED TUBING".

See also Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to oil and gas machinery and devices. In particular, the present invention relates to coiled tubing equipment. More particularly, the present invention relates to a system for dispensing coiled tubing from a reel to a wellhead.

2. Description of Related Art Including Information Disclosed Under 37 CFR 1.97 and 37 CFR 1.98

Coiled tubing is regular component in well interventions, well drilling, and well completions, that is, well servicing operations, like injecting different fluids into a well. Coiled tubing is long and continuous metal pipe that is stored on large reels and dispensed by turning the reel. The coiled tubing is inserted into a well through a wellhead, usually under pressure. Coiled tubing is important because liquids can be pumped into the coiled tubing without reliance on gravity. No pipe connections are required to deploy the coiled tubing into a well under pressure.

An important issue with coiled tubing is the risk of damage when the metal pipe must be bent several times. The first bending event occurs as the coiled tubing is initially straightened as dispensed from the reel. The coiled tubing is bent the second time as the coiled tubing passes onto the gooseneck or guide arch. Then, the third time when the coiled tubing is bent from the gooseneck to the injector. The coiled tubing is bent the fourth time when the coiled tubing is pulled out of the well and bent back onto the gooseneck.

The fifth bend ensues when the coiled tubing is straightened off the gooseneck to be spooled back onto the reel. The straightened coiled tubing bends for the sixth time when winding back onto the reel. Four of the six bends occurs at the gooseneck, with another two bends at the reel.

Prior art patent documents related to bending coiled tubing include U.S. Pat. Nos. 5,279,364, 6,695,048, and US Pub 20040211555. U.S. Pat. Nos. 6,695,048, 5,454,419, 4,899,823 and US Publication No. 20040211555 also disclose goose neck and other arched guide structures. U.S. Pat. Nos. 6,209,634, 7,165,619, 5,803,168, and 7,810,556 disclose various guide members to protect the coiled tubing from damage during the bending. Kinks and severe angles damage coiled tubing. A notch or other structural defect affects the strength, durability and functionality. A damaged coiled tube cannot protect the pressurized contents within the coiled tubing. A tear or gash will weaken the integrity coiled tubing so that fluids and gases in pressure and temperature conditions cannot be safely maintained. When coiled tubing is bent, the amount of bending is controlled so that there is less risk of damage to the coiled tubing. The prior art guides and arcs form a smooth curve for bending the coiled tubing at a safe curvature. Additionally, guide members of the prior art further protect the coiled tubing for the force exerted to bend. There is no quick large force to sharply bend the coiled tubing into position. The amount of bending and the force exerted to bend are controlled.

As metal pipe, there is a limited amount of bending before the structural integrity of the coiled tubing is lost. With some coiled tubing, within internal tubing pressures of 5000 psi, some computer models estimate 20 cycles (sets of 6 bends) before degradation of the coiled tubing, so coiled tubing is not very re-useable. These 20 cycles apply to the interior of the coiled tubing being pressurized relative to the exterior of the coiled tubing, i.e. the coiled tubing being dispensed in the open air. Some computer models also estimate 130 cycles (sets of 6 bends), if there is no pressure differential between the interior of the coiled tubing and the exterior of the coiled tubing. The pressure differential while bending affects the working life of the coiled tubing.

Pressurized bending is another protection for coiled tubing. U.S. Pat. Nos. 4,091,867 and 6,006,839 disclose pressure equalization during the bending process. The pressure inside the coiled tubing and outside the coiled tubing are equalized to extend the working life of the coiled tubing. Reducing the pressure differential between the inside and outside of the coiled tubing further reduces risk of damaging the coiled tubing during a bending process.

Protections of coiled tubing are limited to the coiled tubing within the bending apparatus. There are gaps in protection coiled tubing between the storage of coiled tubing on a reel or spool and the pressure neck device for bending the coiled tubing and between the pressure neck device for bending and the injector into a wellhead. Although conditions for bending are controlled within the prior art pressure neck devices, there are no protections of coiled tubing until the coiled tubing is inserted into the prior art pressure neck devices. The reel or spool dispenses the coiled tubing so that the coiled tubing may be damaged by sharp bends or kinks, while traveling to and being aligned into bending devices at the wellhead. There is a lack of protection between the reel and the wellhead.

FIG. 1 is a schematic side elevation view of a prior art system 1 of a pressure neck 2 at a wellhead 6. FIG. 1 shows that the upright angle of dispensing from the reel 3 changes as more of the coiled tubing 4 is dispensed to the injector 5. The upright angle of dispensing is constantly changing as the path to the pressure neck device changes. There is a high risk of kink and sharp bend damage 7 to the coiled tubing at the inlet to the pressure neck device as the upright angle changes from the reel 3 at full capacity, middle capacity, and low capacity. Only one level of capacity can be aligned with the prior art pressure neck 2 to reduce the risk of damage.

FIG. 2 is a schematic view of the prior art system 1 of the pressure neck 2 in a top plan view. FIG. 2 shows that the lateral angle of dispensing from the reel 3 changes as more of the coiled tubing 4 is dispensed to the injector 5. FIG. 2 shows that the lateral angle of dispensing from the reel 3 also changes as more coiled tubing in dispensed. The lateral angle of dispensing constantly changes and oscillates back and forth between ends of the reel 3 or spool. There is even more risk of kink and sharp bend damage 8 to the coiled tubing at the inlet to the pressure neck device.

With the rigidity of the prior art pressure neck 2, the kink and sharp bend damage 9 can also occur at a junction between the pressure neck 2 and injector 5. The coiled tubing may yank and pull at the outlet of the pressure neck 2, or at the inlet, as in FIGS. 1 and 2.

There is a need for safer dispensing of the coiled tubing from the reel in addition to safer bending of the coiled tubing while in the pressure neck device. The protections within the bending device do not account for the coiled tubing reaching and exiting the pressure neck device.

It is an object of the present invention to provide a system to protect the coiled tubing from the reel to the wellhead.

It is another object of the present invention to provide a system with a bending apparatus to maintain the bend angle of the conduit of the bending apparatus for the coiled tubing.

It is still another object of the present invention to provide a system with a bending apparatus to align an inlet of the bending apparatus with a reel as the angle of coiled tubing changes when being dispensed from the reel.

It is still another object of the present invention to provide a system with a bending apparatus that can reduce buckling risk when the coiled tubing exits the conduit.

It is an object of the present invention to provide a system for inserting coiled tubing from a reel or spool and into a well through a wellhead.

It is an object of the present invention to provide a system to protect the coiled tubing when initially loading from the reel and through the bending apparatus.

It is an object of the present invention to provide a system to reduce bending stress on the coiled tubing between the reel and the apparatus of the present invention.

It is an object of the present invention to provide a safe and reliable system and method to dispense coiled tubing for bending into a wellhead.

These and other objectives and advantages of the present invention will become apparent from a reading of the attached specification.

BRIEF SUMMARY OF THE INVENTION

Embodiments of the present invention include a system for dispensing coiled tubing from a reel to a wellhead. The coiled tubing is stored on the reel and is unraveled to be dispensed to the wellhead or raveled to be gathered from the wellhead. The upright angle of the coiled tubing being dispensed from different levels on the reel changes. The lateral angle of the coiled tubing being dispensed from side to side across the reel also changes. Even though prior art devices, like a pressure neck, protect a controlled bend from the reel to an injector at the wellhead, the changing upright angle and lateral angle of the coiled tubing between the reel and the bending apparatus are not protected from damage to the coiled tubing. The system of the present invention finally provides some protection of the entire path of coiled tubing from the reel to the wellhead, while still protecting the controlled bend or critical bend inside the pressure neck to the injector of the wellhead.

An embodiment of the system includes a reel having a first lateral reel end and a second lateral reel end and bending apparatus comprised of a conduit with a bend portion and a flexible portion. The conduit has a proximal end and a distal end, which determine a conduit bend angle of the conduit. The conduit can be bent, and the conduit bend angle is the amount of bend corresponding to the coiled tubing entering the conduit in one direction and exiting the conduit in another direction. For the changes in upright angle of the coiled tubing from the reel and for some changes in the lateral angle of the coiled tubing from the reel, the conduit is comprised of a bend portion and a flexible portion. The bend portion has an injector end toward the proximal end and a spool end or reel end toward the distal end, which determine a bend angle. The flexible portion has a first flexible end toward the proximal end and a second flexible end toward the distal end, which determine a flexible bend angle. The conduit bend angle is comprised of the bend angle and the flexible bend angle. The second flexible end is positioned relative to the reel so as to determine a reel bend angle at the distal end of the conduit.

The main controlled bend is isolated in the bend portion, while smaller adjustment bends are allowed for the flexible portion to account for the coiled tubing coming from different ends and radii of the reel and the distance of the reel from the bending apparatus. The changes in the upright angle from dispensing coiled tubing from different levels and sides of the reel and distance of the reel no longer cause damage because the flexible bend angle can adjust to those changes. The changes in the lateral angle from dispensing coiled tubing from different levels of the reel no longer cause damage because the flexible bend angle can also adjust to those changes.

Embodiments of the system of the present invention are also compatible with safety components at both proximal and distal ends of the conduit. The safety components can reduce buckling of the coiled tubing and retain coiled tubing in the bending apparatus and injector, in emergency cut-off situations.

DETAILED DESCRIPTION OF THE INVENTION

Figure 1:
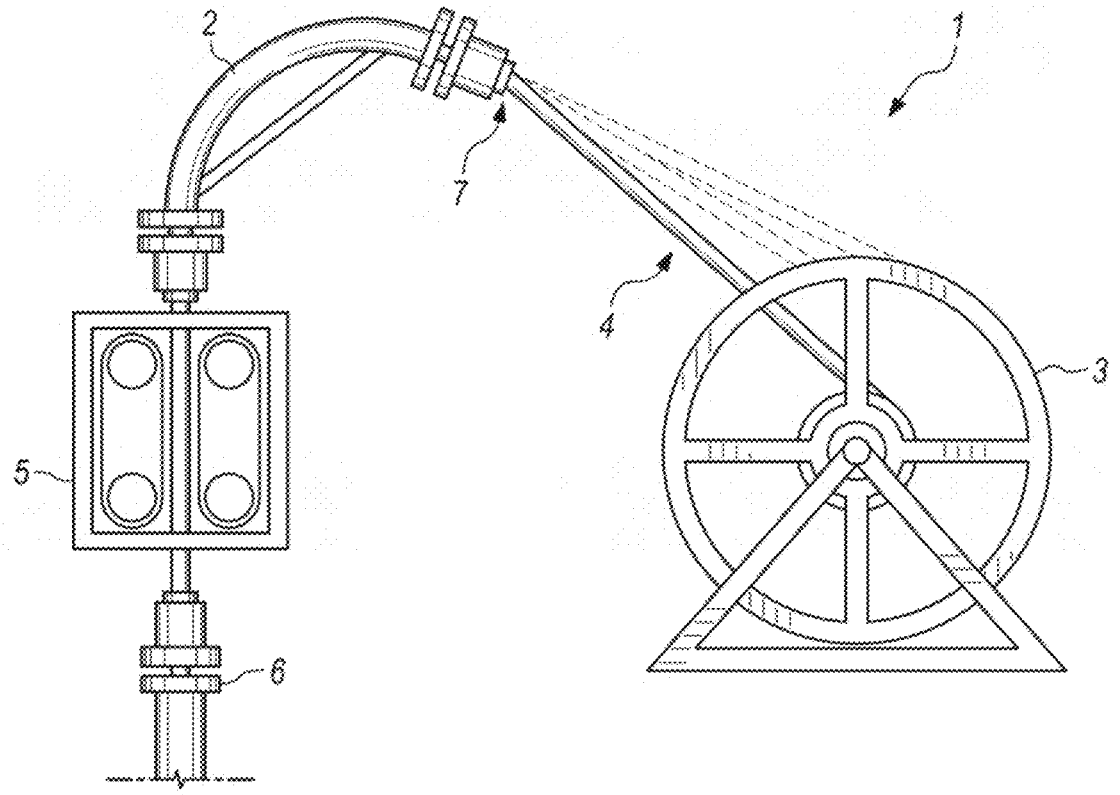
FIG. 1 Prior Art
FIG. 1 is a schematic side elevation view of a prior art system of a pressure neck or guide arc.
Figure 2:
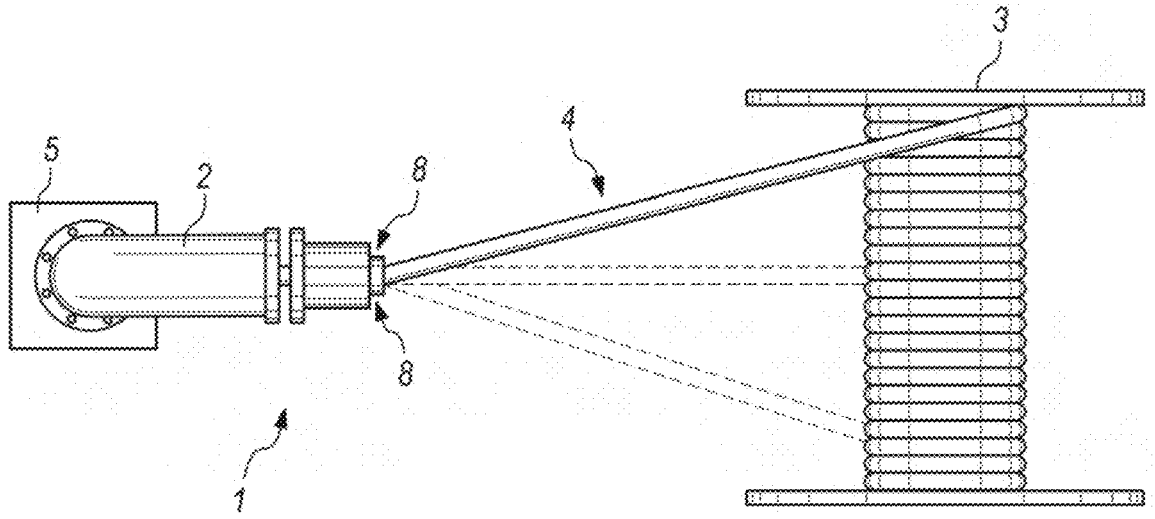
FIG. 2 Prior Art
FIG. 2 is a schematic view of the prior art system of a pressure neck or guide arc in a top plan view.

Dispensing coiled tubing is one step in the process of inserting the coiled tubing into a well through a wellhead. The coiled tubing is already known to be stored on a reel or spool and dispensed from the reel or spool. The coiled tubing is stored in a bent or curved configuration and is unraveled from the reel or spool only to be bent again so as to be aligned with an injector at the wellhead. The injector inserts the coiled tubing through a wellhead, usually under pressure. The protection of the coiled tubing during the step of bending and the devices to perform the bending for the injector at the wellhead are known in the prior art as a pressure neck. However, there are additional risks for damage separate from the critical bending to the injector. In particular, the path from the reel or spool to the pressure neck and the path from the pressure neck to the injector have high risks for damage, that could render the coiled tubing non-functional or negatively affect the working life of the coiled tubing. The system of the present invention still protects the critical bend angle of the coiled tubing, which is the important bending of the coiled tubing for alignment into the injector. However, the system of the present invention further protects the coiled tubing from excessive bending between the reel and the bending apparatus.

In the system of the present invention, the bend portion is clearly distinguished from the flexible portion so that the bend angle of the bend portion corresponds to the critical bend angle of the coiled tubing at the injector for the wellhead. Not all bending in the bending apparatus is treated the same. The bend angle of the bend portion is protected by the flexible bend angle of the flexible portion, according to the reel bend angle. The flexible portion accounts for the coiled tubing coming from different ends and dispensing radius from the reel and the variable distance of the reel from the bending apparatus. The smaller, but more dynamic, adjustments are made by the flexible portion. The flexible portion reduces the impact of these more dynamic adjustments required from the dispensing of the coiled tubing from the reel. The bending apparatus itself is not pulled and yanked as in the prior art. The flexible portion is pulled and yanked so that the flexible bend angle transitions the coiled tubing to the bend angle with more stability and support. There is less risk of damage to the coiled tubing by the transition from any part of the reel according to distance to the injector when the flexible portion transitions coiled tubing to the bend angle of the bend portion for the critical bend angle of the coiled tubing.

The present invention is a system 10 for dispensing coiled tubing. The system 10 includes a reel 12 having a first lateral reel end 14 and a second lateral reel end 16 opposite the first lateral reel end 16, and a bending apparatus 18. FIGS. 3-11 show embodiments of the system 10 with the bending apparatus 18 comprising a conduit 20. The conduit 20 has a proximal end 22 and a distal end 24 opposite the proximal end. The proximal end 22 is positioned relative to the distal end 24 so as to determine a conduit bend angle 26 of the conduit. The conduit 20 is bent, and the conduit bend angle 26 is the amount of bend corresponding to the coiled tubing entering the conduit 20 in one direction and exiting the conduit 20 in another direction, corresponding to the conduit bend angle 26. The proximal end 22 does not face opposite the distal end 24 because of the conduit bend angle 26. The face of the proximal end 22 is angled relative to the face of the distal end 24. The conduit bend angle 26 is a controlled and protected bend of the present invention to dispense coiled tubing from the reel 12 to an injector of a well head.

FIGS. 3-12 show embodiments of the conduit 20 of the system 10 being comprised of a bend portion 30 and a flexible portion 60. The bend portion 30 has an injector end 32 toward the proximal end 22 and a spool end 34 toward the distal end 24 and opposite the injector end 32. The injector end 32 is positioned relative to the spool end 34 so as to determine a bend angle 36 of the bend portion 30. FIGS. 3-11 further show the conduit 20 being comprised of a flexible portion 60 having a first flexible end 62 toward the proximal end 22 and a second flexible end 64 toward the distal end 24 and opposite the first flexible end 62. The first flexible end 62 is positioned relative to the second flexible end 64 so as to determine a flexible bend angle 66 of the flexible portion 60.

Figure 3:
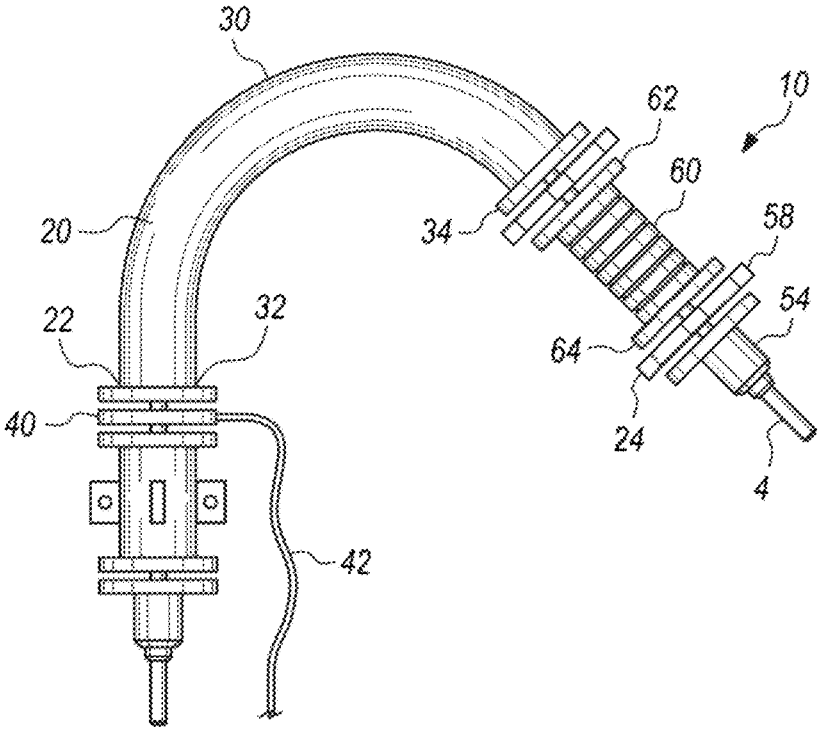
FIG. 3 is a side elevation view of an embodiment of a bending apparatus of the system, according to the present invention.
Figure 12:
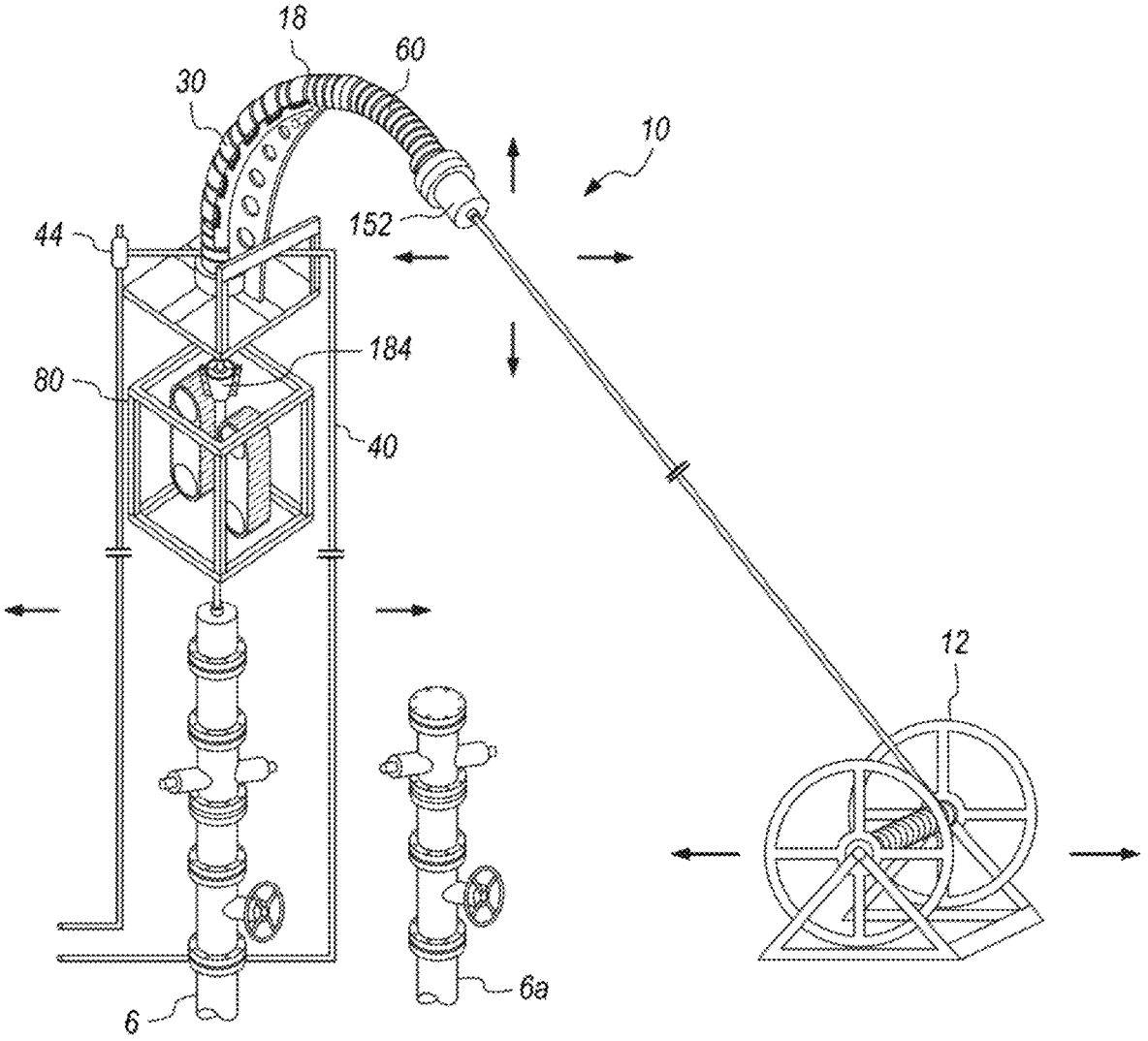
FIG. 12 is a perspective view of another embodiment of the system with still another alternate bending apparatus and reel with a floating proximal stripper for dispensing coiled tubing to wellheads at different distances from the system.

FIGS. 3-7 show an embodiment of the system 10 with the reel 12 and the bending apparatus 18 with the bend portion 30 between the flexible portion 60 and the proximal end 22. FIGS. 8-11 show an embodiment of the system 10 with the reel 12 and the bending apparatus 18 with the flexible portion 60 between the bend portion 30 and the proximal end 22. FIG. 12 shows another embodiment of the system 10 with an alternate bending apparatus 18 and reel 12 with a floating stripper 152 for dispensing coiled tubing to wellheads 6, **6*a* at different distances from the system 10. The bend portion 30 can also be pressurized. The pressure equalization of the interior of the coiled tubing and the exterior of the coiled tubing, while the coiled tubing passes through the bend portion increases the working life of coiled tubing. The pressure control on both the interior and exterior of the coiled tubing reduces stress of the bend. FIG. 3 and FIG. 12 show the means 40 for pressurizing the bend portion 30 from the injector end 32 to the spool end 34. The means 40 for pressurizing includes a pressure hose 42 in fluid connection with the bend portion 30 at the injector end 32. The pressure hose 42 can regulate the pressure within the bend portion 30. The means 40 for pressurizing can include other components, such as pumps, seals, spools, including but not limited to kill spools, pressure safety valves 44, pressure relief valves, other valves, O-rings, a bleed ring and bleed hose to control pressure, including releasing excess pressure from the bend portion 30. The means 40** for pressurizing can also include alternatives to a pressure hose, such as a spool, including but not limited to a kill spool, or flow tee valves or other fluid passageways.

The bend angle 36 avoids impingement between distal end 24 and proximal end 22. Analogous to the protection of prior art pressure necks and guides, the bend angle 36 of the bend portion 30 reduces bending stress and avoids kinks [in] into the main controlled bend. The flexible bend angle 66 of the flexible portion 60 also avoids impingement between the distal end 24 and the proximal end 22. The reel bend angle 13 is determined by the second flexible end 64 being positioned relative to the reel 12. The reel bend angle 13 at the distal end 24 of the conduit 20 ranges between the first lateral reel end 14 and the second lateral reel end 16, as in FIGS. 5-7 and 9-11. The reel bend angle 13 also ranges between an outer radius 15 of the reel 12 and an inner radius 17 of the reel 12, as in FIGS. 4 and 8. The inner radius 17 is smaller than the outer radius 15. The reel bend angle 13 is determined by the variable distance of the reel 12 to the bending apparatus 18 and the point of release of coiled tubing from the reel 12 between the first lateral reel end 14 and the second lateral reel end 16 and between the outer radius 15 and the inner radius 17 of the reel 12. The variable distance is the distance of the reel to the bending apparatus when the coiled tubing is being dispensed. The variable distance can change, especially when the system 10 and injector are moved from one wellhead 6 to a different wellhead 6*a*, as shown in FIG. 12.

The flexible bend angle 66 and the reel bend angle 13 reduce bending stress and avoid kinks through the system 10 from the reel 12 to the bend portion 30 of the conduit 20 with the bend angle 36 corresponding to the critical bend angle of the coiled tubing for the injector at the wellhead. The flexible bend angle 66 transitions the coiled tubing from the reel 12 according to the distance and section of the reel 12 dispending the coiled tubing. The flexible portion 60 just being flexible does not re-introduce the risk of damage from sharp bends and kinks from the prior art. The flexible portion 60 protects the bend portion 30 from sharp bends and kinks from the prior art. The flexible portion 60 of the present invention is defined by the flexible bend angle 66 and reel bend angle 13 such that the amount of flexibility of the flexible portion 60 is controlled and safe for coiled tubing. The more dynamic movement of the conduit 20 can be distributed between the bend portion 30 and the flexible portion 60 and to the flexible portion 60 so that the critical bend angle of the coiled tubing is always protected.

Figure 4:
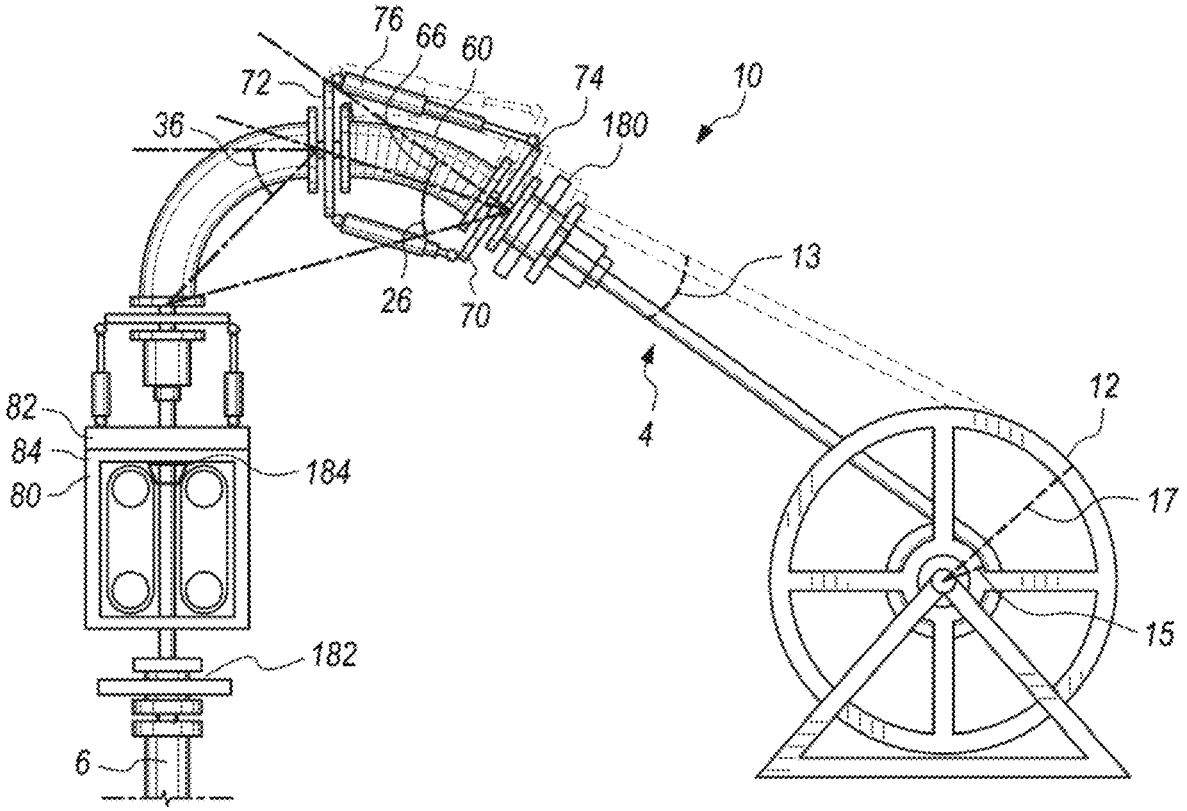
FIG. 4 is a side elevation view of an embodiment of a system with a bending apparatus and reel for dispensing coiled tubing, according to the present invention.
Figure 5:
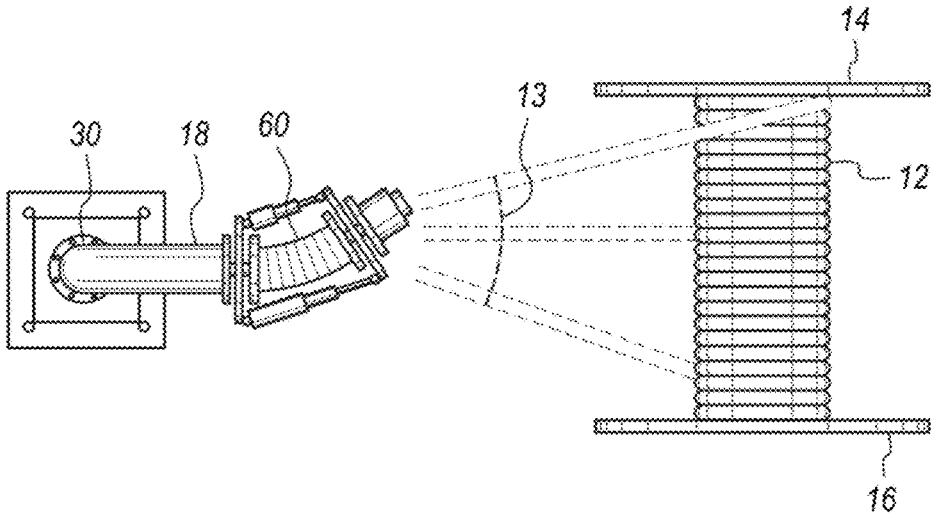
FIGS. 5-7 are top plan elevation views of the embodiment of FIG. 4 in the wellhead system for coiled tubing, according to the present invention.
Figure 6:
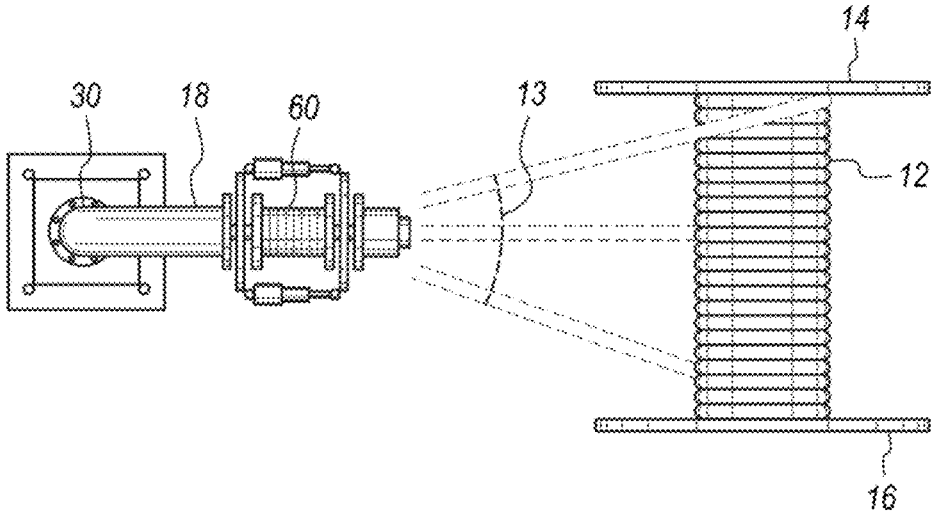
Figure 7:
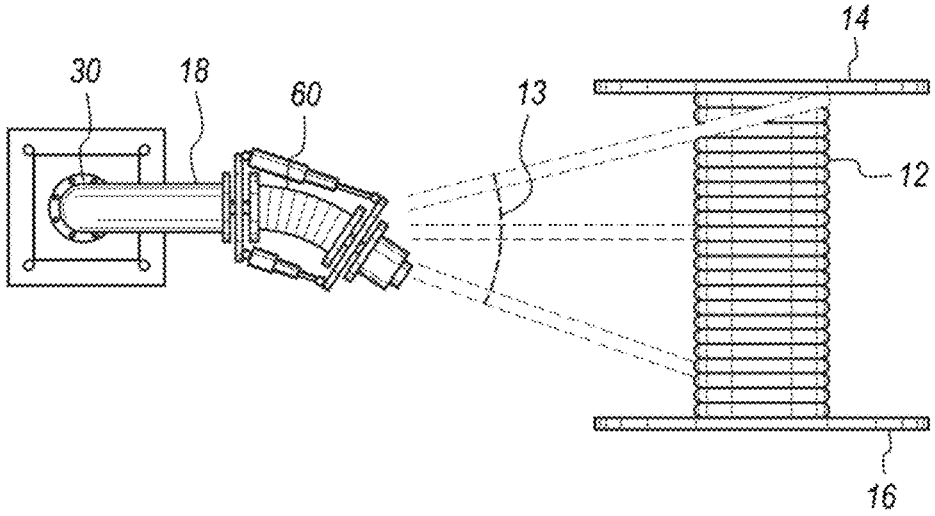
Figure 8:
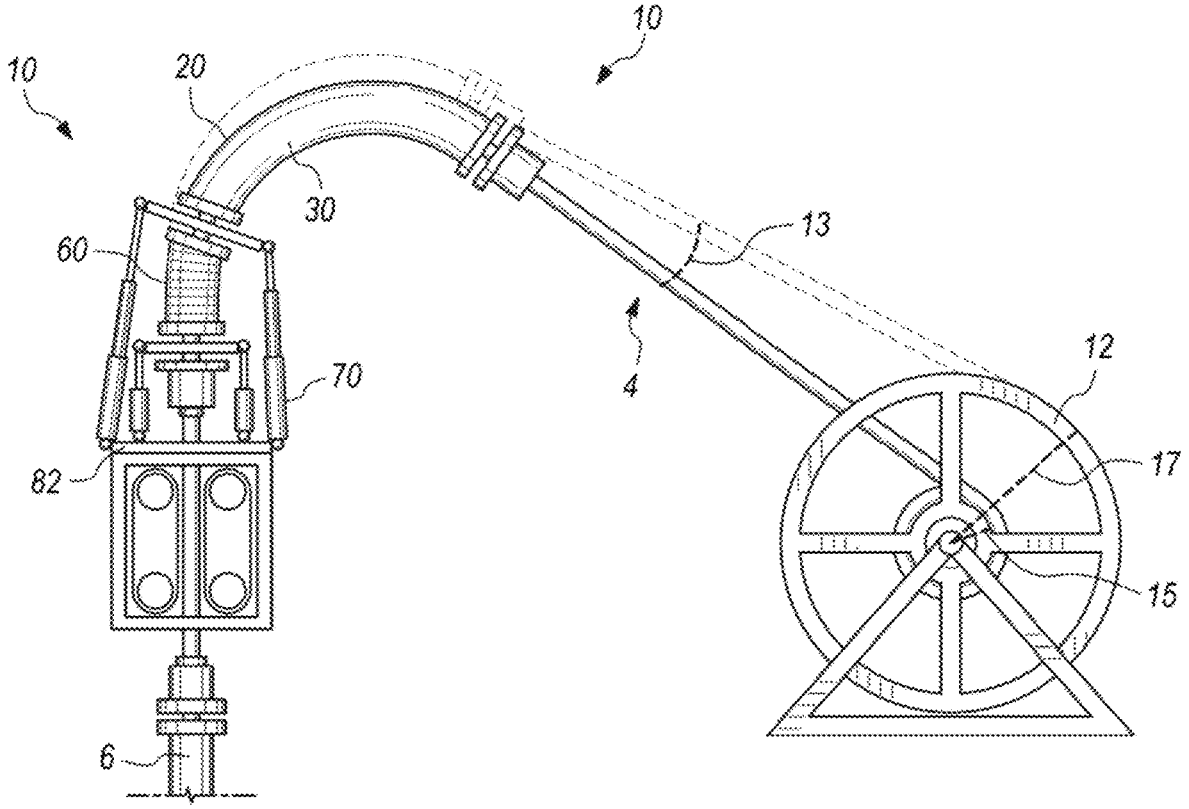
FIG. 8 is a side elevation view of another embodiment of the system with an alternate bending apparatus and reel for dispensing coiled tubing, according to the present invention.
Figure 9:
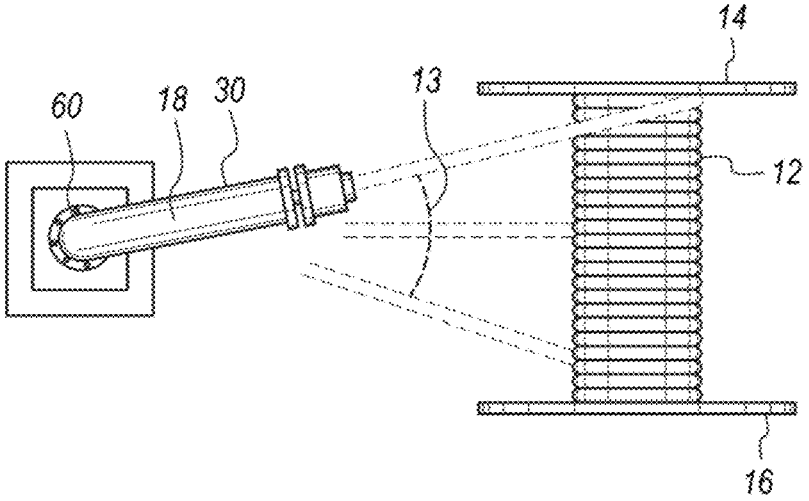
FIGS. 9-11 are top plan elevation views of the embodiment of FIG. 8 in the wellhead system for coiled tubing, according to the present invention.
Figure 10:
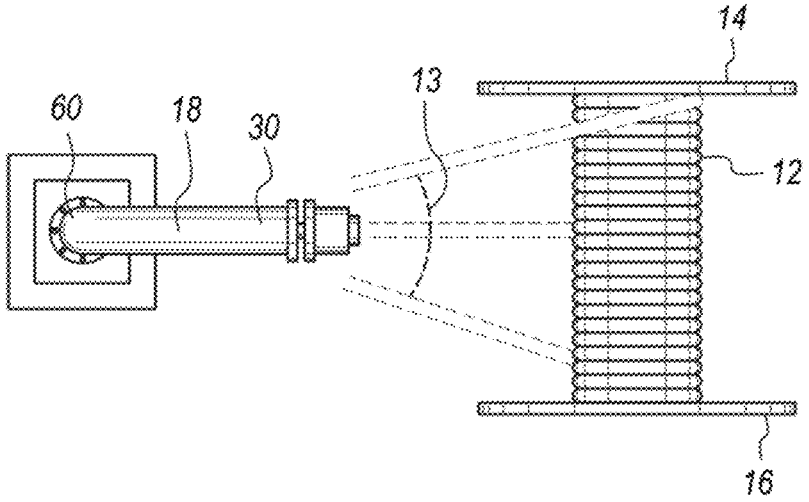
Figure 11:
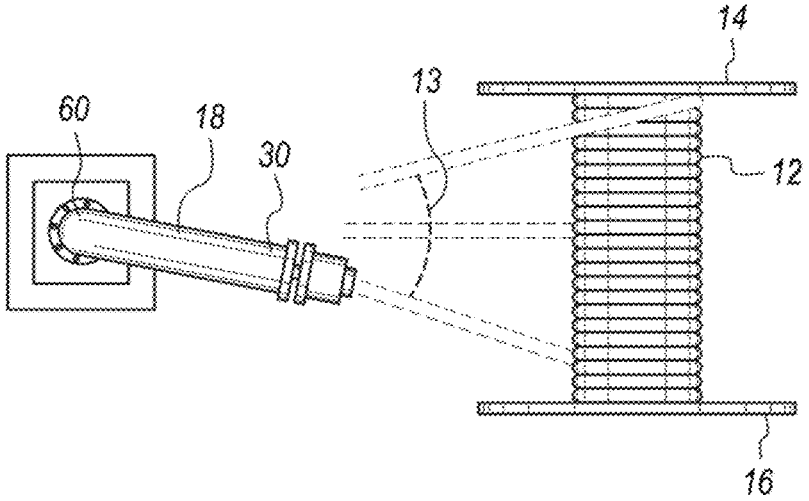

Embodiments of the dispensing system 10 show that the conduit bend angle 26 is comprised of the bend angle 36 and the flexible bend angle 66. The flexible bend angle 66 is determined by the reel bend angle 13. In FIGS. 4-12, the flexible bend angle 66 is less than the bend angle 36 and the reel bend angle 13 is less than the bend angle 36. The bend angle 36 of the bend portion 30 is responsible for the critical bend angle of coiled tubing between the injector 5 and the bend portion 30, which can apply the most of the bending from the reel 12 to the wellhead 6. The bend portion 30 still controls for the same protections against the sharpness of the bend, amount of force to bend, and the rate of bending in order to avoid damage and kinks in the coiled tubing. The flexible portion 60 now accounts for finer adjustments due to upright angle and lateral angle of the coiled tubing from the reel 12, and the variable distance of the reel 12 to the bending apparatus 18. FIG. 12 shows the system 10 with a floating stripper 152 at the distal end 24. Lightweight supports can be used or excluded. The floating stripper 152, with or without lightweight supports, can be suspended on the coiled tubing to move with the other components of the system 10 with dynamic changes to the reel bend angle 13 and from the wellhead 6*a*. The variable distance corresponds the respective distance of wellheads 6, 6*a* to the system 10. The flexible portion 60 maintains the safe flexible bend angle, even with the changes to the reel bend angle 13 by the variable distance, in addition to the upright angle and lateral angle from the dimensions of the reel 12. FIGS. 4 and 8 show the system 10 that separates the critical bend angle of the coiled tubing in the bend portion 30 from the minor bends in the flexible portion 60 related to the adjustments needed due to reel bend angle 13 and the mechanics of raveling and unraveling from the reel 12.

FIGS. 4 and 8 show an optional table mount 80 connected to the proximal end 22 of the conduit 20. The table mount 80 is comprised of a table plate 82 connected to the proximal end 22, and a table base 84 in swiveling engagement to the table plate 82. The conduit 20 and the table plate 82 can be rotatable together relative to the table base 84. The table base 84 can be fixed in position to the injector so that the reel bend angle 13 can remain less than the bend angle 36. The table base 84 is complementary to the conduit 20 for adjusting the reel bend angle 13 according to distance between the reel 12 and the conduit 20 and the point of dispensing from the reel 12.

FIGS. 4-8 also show embodiments with a support means 70 for the flexible portion 60. The support means 70 can include a support bracket 72, 74 and a support arm system 76. FIG. 4 shows a first support bracket 72 at the first flexible end 62, a second support bracket 74 at the second flexible end 64, and support arm system 76. The support arm 76 can be a single support arm or a plurality of support arms. Each support arm 76 can be connected to the first support bracket 72 and the second support bracket 74. The support arms 76 hold position of the first flexible end 62 relative to the second flexible end 64. Other embodiments of a support means 70 may include a single support arm, multiple support arms, and different combinations of flanges, collars, and inflatable collars. The support brackets may also be flanges, collars or inflatable collars. Various winches, cables and pulleys can also be incorporated into a support means of the invention. Although flexible for adjustments due to variations in distance, the upright angle and the lateral angle from the reel, the flexible portion 60 can be stabilized to allow for the coiled tubing to pass through any of the variations in the uprights angle or lateral angle or both. A table mount is no longer required as the distal end has the range to account for the lateral angle changes of the coiled tubing from the reel.

Embodiments of the system 10 are also compatible with safety components. FIG. 4 shows an embodiment with a distal blow-out preventer 180 at the distal end 24. In an emergency, a blow-out preventer (BOP) has blind shear rams that can cut the coiled tubing, when triggered. The distal BOP 180 enables the present invention to cut the coiled tubing and retain the cut coiled tubing within the bending apparatus 18 of the system 10. The coiled tubing no longer risks falling back into the wellhead, when an emergency triggers the distal BOP 180. The coiled tubing is retained within the bending apparatus 18 as pressurized and with any fluids therein. With coiled tubing pressure and a fluid connection (such as the pressure hose 42 of the means for pressurizing 40) in the conduit 20, the well can be killed by circulating fluid down the cut coiled tubing. There is also a proximal blow-out preventer 182 at the proximal end 22 as in the prior art. The proximal BOP 182 remains as a conventional location that can cut the coiled tubing in emergencies. The proximal BOP 182 allows the coiled tubing to still be intentionally cut, while intentionally falling back into the wellhead. There may be some emergency circumstances in which coiled tubing should not be left holding in the pressure neck as the bending apparatus 18 of the system 10. The present invention can account for both types of emergencies for the versatility to sometimes preserve the coiled tubing out of the wellhead. The efficiency and recovery can be much faster for these types of emergencies with the present invention. The present invention is compatible with both safety components in both locations relative to the conduit 20.

FIG. 4 shows another embodiment of the system 10 compatible with another safety component. There is a buckle protector 184 at the proximal end 22. The transition from bending apparatus 18 of the system 10 to the injector is protected. Once bent properly at the critical bend angle, the present invention is compatible with further protecting the coiled tubing as the coiled tubing exits the conduit 20. The buckle protector 184 is another known redundancy that can be incorporated into the present invention. The present invention reduces coil tubing buckling forces in the space between the bending apparatus and the tracks or gripping blocks of an injector. It is also noted that the distal blow-out preventer (BOP) 180 at the distal end 24, the proximal blow-out preventer (BOP) 182 at the proximal end 22, and the buckle protector 184 can be incorporated into the embodiments of the bending apparatus in FIG. 4.

In addition to protecting coiled tubing through the critical bend to the injector at a wellhead, the present invention provides a system for safely dispensing coiled tubing from reel to wellhead. The present invention protects the coiled tubing from additional risks when being dispensed between lateral ends of the reel, from inner to outer radii of the reel, and at a distance from the conduit of the bending apparatus. The distance is variable to affect the angle of the coiled tubing from the reel to the bending apparatus. The system is also compatible with moving the injector from well to well. The bending apparatus of the system can remain connected to the injector as the injector is moved. The system protects the coiled tubing between the reel and the bending apparatus and between the bending apparatus and the injector of the wellhead. Between the reel and the bending apparatus, the upright angle of dispensing from the reel changes according to distance as coiled tubing is unraveled and raveled. The present invention includes a flexible portion to account for these changing angles, which prevents damage, such as tears, strains, and kinks.

The bend portion of the present invention is still part of a system with a bending apparatus and reel so as to maintain the bend angle of the conduit of the bending apparatus for the coiled tubing. The coiled tubing is still bent between an inlet and outlet of the bending apparatus, and the system reduces buckling risk when the coiled tubing exits the conduit. The system protects the coiled tubing when initially loading from the reel and through the bending apparatus of the system. The flexible bend angle and reel bend angle make smaller and dynamic adjustments to protect the coiled tubing dispensed from the reel to the conduit. The flexible portion reduces the impact of these more dynamic adjustments required from the dispensing of the coiled tubing from the reel. The flexible portion is fine tuning of the alignment of the coiled tubing so that there are no tears, strains or kinks as the coiled tubing enters or exits the conduit. The flexible portion can adjust, but the flexible portion must also be sufficiently stable to remain aligned with the conduit. There is less risk of damage to the coiled tubing by the transition from the reel to the injector when the flexible portion transitions coiled tubing to the bend angle of the bend portion for the critical bend angle of the coiled tubing.

Safety components can be incorporated into the system of the present invention. Blow-out preventers and buckle protectors are compatible with the system of the present invention for further support and protection of the coiled tubing. There is also the particular advantage of the coiled tubing being retained within the bending apparatus as pressurized and with any fluids therein. With coiled tubing pressure in the conduit, the well can be killed by circulating fluid down the cut coiled tubing. The recovery from an emergency can be much faster. The ends of the conduit are also compatible with various attachments for support and protection of the coiled tubing.

The foregoing disclosure and description of the invention is illustrative and explanatory thereof. Various changes in the details of the illustrated structures, construction and method can be made without departing from the true spirit of the invention.

I claim:

1. A system for dispensing coiled tubing, the system comprising:

a reel having a first lateral reel end and a second lateral reel end opposite said first lateral reel end; and a bending apparatus comprising:

a conduit having a proximal end and a distal end opposite said proximal end, wherein said proximal end is positioned relative to said distal end so as to determine a conduit bend angle of said conduit, wherein said conduit is comprised of:

a bend portion having an injector end toward said proximal end and a spool end toward said distal end opposite said spool end, wherein said injector end is positioned relative to said spool end so as to determine a bend angle of said bend portion; and a flexible portion having a first flexible end toward said proximal end and a second flexible end toward said distal end and opposite said exit end, wherein said first flexible end is positioned relative to said second flexible end so as to determine a flexible bend angle of said flexible portion, wherein said conduit bend angle is comprised of said bend angle and said flexible bend angle, wherein said flexible bend angle is less than said bend angle so as to protect coiled tubing from damage when bending in said bend portion at said bend angle, wherein said second flexible end is positioned relative to said reel so as to determine a reel bend angle at said distal end of said conduit, and wherein said reel bend angle is less than said bend angle so as to protect coiled tubing from damage when being dispensed from said reel to said bending apparatus.

2. The system for coiled tubing, according to claim 1, wherein said reel bend angle at said distal end of said conduit ranges between said first lateral reel end and said second lateral reel end.

3. The system for coiled tubing, according to claim 2, wherein said reel bend angle at said distal end of said conduit ranges between an outer radius of said reel and an inner radius of said reel, said inner radius being smaller than said outer radius.

4. The system for coiled tubing, according to claim 1, wherein said reel bend angle at said distal end of said conduit ranges between an outer radius of said reel and an inner radius of said reel, said inner radius being smaller than said outer radius.

5. The system for coiled tubing, according to claim 1, wherein said reel is positioned a variable distance from said bending apparatus according to said reel bend angle at said distal end of said conduit.

6. The system for coiled tubing, according to claim 1, further comprising:

a distal blow-out preventer at said distal end.

7. The system for coiled tubing, according to claim 6, further comprising:

a proximal blow-out preventer at said proximal end.

8. The system for coiled tubing, according to claim 1, further comprising:

a buckle protector at said proximal end.

9. The system for coiled tubing, according to claim 1, further comprising:

a distal stripper attached to said distal end; and a proximal stripper attached to said proximal end.

10. The system for coiled tubing, according to claim 1, further comprising:

a floating stripper attached to said distal end.

* * * * *